US007403116B2

(12) United States Patent
Bittner

(10) Patent No.: US 7,403,116 B2
(45) Date of Patent: Jul. 22, 2008

(54) CENTRAL MONITORING/MANAGED SURVEILLANCE SYSTEM AND METHOD

(75) Inventor: Darjon Bittner, Cedar Hill, TX (US)

(73) Assignee: Westec Intelligent Surveillance, Inc., Gainesville, VA (US)

( * ) Notice: Subject to any disclaimer, the term of this patent is extended or adjusted under 35 U.S.C. 154(b) by 145 days.

(21) Appl. No.: 11/364,483

(22) Filed: Feb. 28, 2006

(65) Prior Publication Data

US 2006/0195716 A1 Aug. 31, 2006

Related U.S. Application Data

(60) Provisional application No. 60/657,112, filed on Feb. 28, 2005.

(51) Int. Cl.
*G08B 21/00* (2006.01)

(52) U.S. Cl. ..... 340/540; 340/541; 340/565; 348/143

(58) Field of Classification Search ..... 340/533
See application file for complete search history.

(56) References Cited

U.S. PATENT DOCUMENTS

| | | | | |
|---|---|---|---|---|
| 6,204,762 | B1 | 3/2001 | Dering et al. | |
| 6,720,990 | B1 | 4/2004 | Walker et al. | |
| 6,778,084 | B2 | 8/2004 | Chang et al. | |
| 7,248,161 | B2 * | 7/2007 | Spoltore et al. | 340/539.14 |
| 2003/0117280 | A1 | 6/2003 | Prehn | |
| 2005/0184867 | A1 * | 8/2005 | Osann | 340/539.25 |

* cited by examiner

*Primary Examiner*—George A Bugg
(74) *Attorney, Agent, or Firm*—Winstead PC

(57) ABSTRACT

A method for remotely monitoring a first location. The method includes providing surveillance equipment at the first location. Data is transmitted from the security equipment via IP connectivity to a second location that is remote from the first location. The data is monitored in real-time from the second location.

18 Claims, 6 Drawing Sheets

CENTRAL MONITORING/MANAGED SURVEILLANCE SYSTEM AND METHOD

CROSS-REFERENCE TO RELATED APPLICATIONS

This application claims the benefit of priority of U.S. Provisional Patent Application No. 60/657,112, filed Feb. 28, 2005, which is hereby incorporated by reference in its entirety.

FIELD OF THE INVENTION

The present invention relates to a remote monitored surveillance system, and more particularly to a remote surveillance system that includes data that is transmitted in real-time over the internet.

BACKGROUND OF THE INVENTION

In traditional surveillance systems, the surveillance either takes place on-site or off-site. On-site surveillance often involves hiring security personnel to monitor hard-wired video feeds from around the site. Usually, the surveillance only involves monitoring the site for security reasons and does not perform any business-auditing. Also, having an on-site security staff can cost-prohibitive for many businesses.

Alternatively, residences and businesses may use off-site security services. The off-site security reduces the cost, because each business does not have to hire security personnel. In many of today's off-site applications, the security services are only performing burglary monitoring. In these cases, if there is a breach in security at a site being monitored, the off-site security company receives an alarm. In response to the alarm, the security company then alerts the police. However, the security company cannot distinguish false alarms from real alarms and cannot view, in real-time, the event that caused the alarm.

Also, some businesses would like to monitor certain tasks such as how often certain tasks are performed (e.g., restocking the shelves, emptying the trash), how friendly their employees are to customers, and timeliness of service. General security monitoring cannot perform such automated intelligent audits.

Therefore, there is a need for real-time, off-site surveillance that allows for security surveillance as well as business auditing.

SUMMARY OF THE INVENTION

In accordance with one embodiment of the present invention, a method for remotely monitoring a first location is provided. The method includes providing surveillance equipment at the first location. The data from the surveillance equipment is transmitted via IP connectivity to a second location that is remote from the first location. The data is then monitored in real-time from the second location.

According to yet another embodiment of the present invention, a system for providing remote surveillance is provided. The system includes surveillance equipment located at a first location and a central server located a second location. The central server is operable to receive data via IP connectivity from the surveillance equipment. At least one workstation is coupled to the server for displaying the received data in real-time.

According to yet another embodiment, a method of performing remote surveillance is provided. The method includes detecting a first event at a first location via surveillance equipment. A second event is detected at the first location via the surveillance equipment. A central server is alerted at a second location via IP connectivity in response to the first and second events occurring within a predetermined time limit.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

DESCRIPTION OF ILLUSTRATIVE EMBODIMENTS

Figure 1:
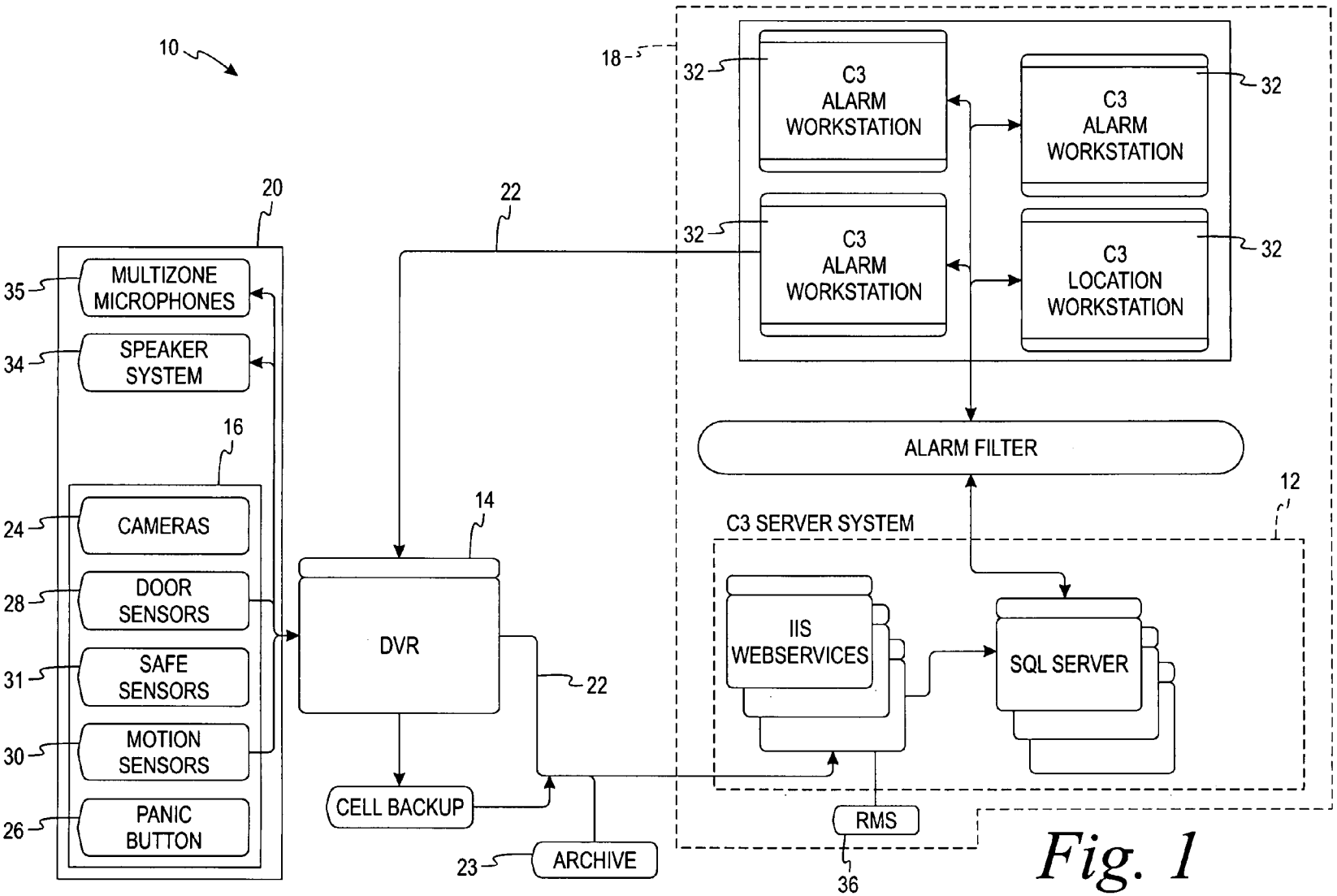
FIG. 1 is a block drawing of a monitoring system according to one embodiment of the present invention.

Turning now to FIG. 1, a remote monitoring system 10 is illustrated. The remote monitoring system 10 includes a central server 12 connected to a digital video recorder (DVR) system 14, which is in turn connected to a plurality of on-site security monitoring devices, or surveillance equipment, 16. The central server 12 is located at a remote surveillance monitoring location 18. The DVR system 14 and the security monitoring devices 16 are located at a site being monitored 20. The DVR system 14 is connected to the central server 12 via an IP connection 22. The DVR system 14 also records and stores some information obtained by the various security devices 16 and saves them for alter viewing and its capabilities will be further described below in reference to FIG. 2.

As illustrated in FIG. 1, the security devices include a plurality of video cameras 24, panic buttons 26, door sensor 28, motion detectors 30, safe sensors 31 any contact monitored device and any RS232 device. When the site is being monitored for security purposes, the DVR system monitors the security devices 16. Should an event occur at one of the security devices (e.g., one of the motion detectors 30 detect motion, or one of the panic buttons 26 being activated), an alarm at the remote monitoring site would be activated, notifying security personnel of an alarm incident. This is accomplished by the DVR system 14 sending notification over the IP connection 22 to the central servers 12 and transmitting the required information. The security personnel could then access the IP connection 22 and via a workstation 32, view the event details including audio and the video output. Generally, there may be more than one workstation 32. The workstation 32 may include a multiplex monitor, meaning that the views from each camera 24 at the site being monitored 20 can be seen at once. Additionally or alternatively, the workstation 32 may include a cycling monitor, meaning that the monitor 32 only shows output from one camera 24 at a time, but cycles through each camera 24. The security personnel can view the data from the video cameras 24 in real-time, so that the security personnel can see if there is indeed a burglar or other problem that requires police notification. The security personnel can also replay the video from the time of the alarm to review the event that set off the alarm.

In some embodiments, the site being monitored 20 includes a speaker 34 and a microphone 35 that are connected via the IP connection 22 to the remote surveillance monitoring location 18 and the central server 12. Security personnel at the remote surveillance monitoring location 18 can give instructions over the speaker 34 to a person who is in the site being monitored 20. For example, if the security personnel sees an intruder to the site being monitored, the security personnel can, via the speaker 34, order the person to stop. In many instances, because the intruder does not know that the person on the speaker is not there, the intruder is likely to leave. This prevents damage being done to the property and can also avoid having to call in the police if they are not needed.

In some embodiments, the central server 12 and/or the DVR system 14 could provide pre-recorded voice messages to the speaker 34. For example, if the system 10 detects an intruder about to break in, the DVR system 14 could automate a pre-recorded voice message that urges the intruder not to break in. Alternatively, if a person is about to vandalize the site being monitored 20, the DVR system 14 could transmit a different pre-recorded voice message. In other embodiments, the DVR system 14 or workstation 32 may transmit one voice recording regardless of the event. Also the microphones 35 allow the intruder (or person being watched) to speak with the security personnel. The microphones also allow audio events to be recorded on the DVR system 14 and the security personnel at the workstation 32 to listen to events that occur at the site being monitored 20.

The central server 12 is coupled to a remote manager server 36, which stores the internet protocol database. The remote manager server 36 may be built on any standard, known server platform, such as Microsoft Windows Server System Platform. The remote manager server 36 operates on a defined schedule, checks system connectivity, runs system health checks, centralizes remote data synchronizes server configuration and the latest application updates.

While in operation, during predefined intervals (e.g., five minutes), the remote manager server 36 communicates with the DVR system 14 to check security devices 16 (in some embodiments, specifically the video cameras 24). Regular communication allows the remote manager server 36 to ensure connectivity and functionality of the video cameras 24. The remote manager server 36 also centralizes remote data log files, data capture and intelligent video capture for business analysis. The centralization of all of the reports from each remote site allows for faster and more secure retrieval of the data. Also, the data is more easily managed since it is stored in one central location.

In the case where the remote manager server 36 has not received any communications from a particular site being monitored, the remote manager server 36 can communicate with the DVR system 14 to restore the site to full operation. For example, if the remote manager server 36 determines that one of the door sensors 28 is not properly connected, the central server 12 can alert personnel to fix the sensor 28. Alternatively, the remote manager server 36 can also operate to inform the security personnel of an alarm situation. As stated above, the security personnel can then review the situation and alert the police as needed.

Figure 2:
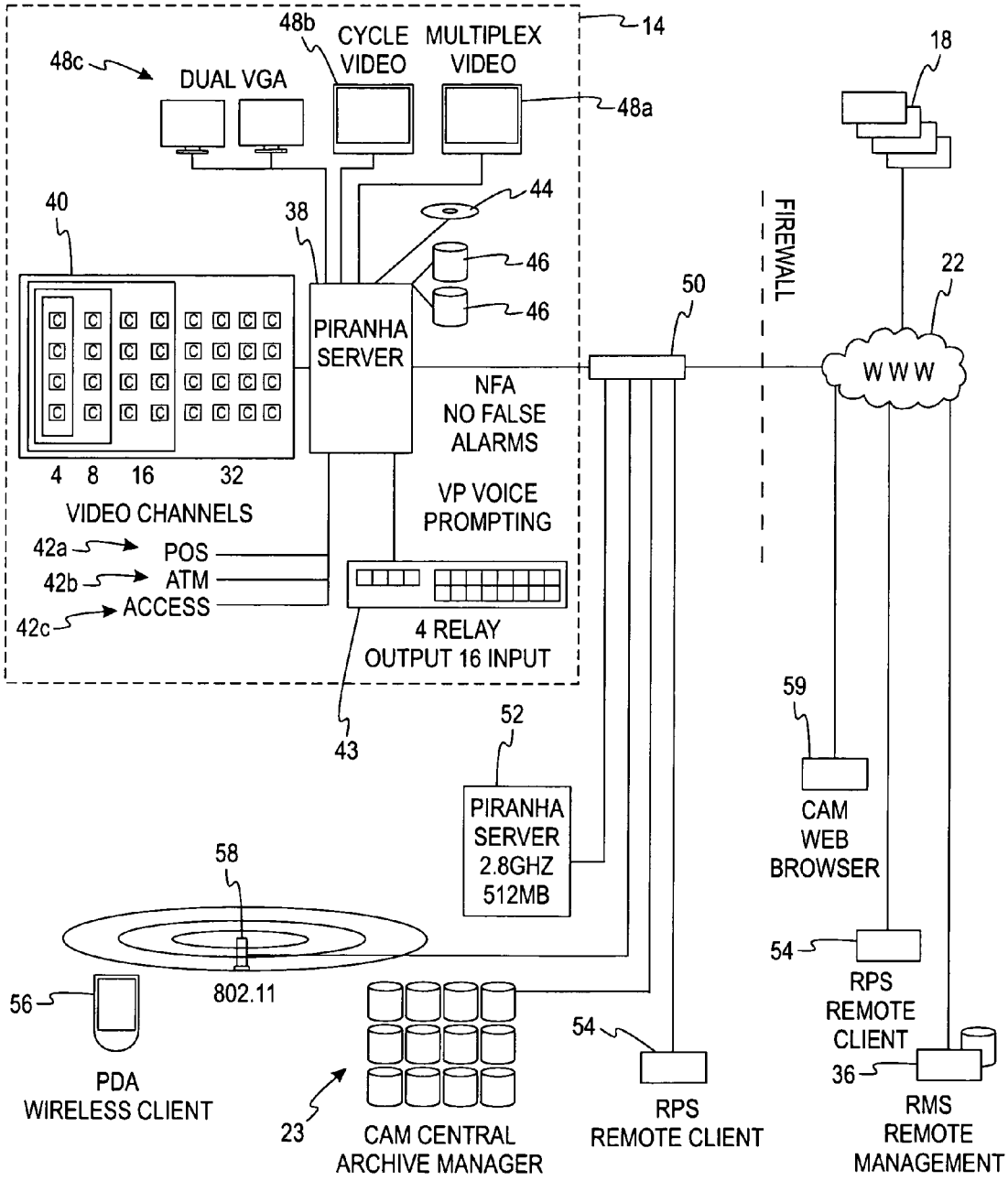
FIG. 2 is a network diagram of the monitoring system according to one embodiment of the present invention.

Turning now to FIG. 2, a more detailed view of the DVR system 14 and its connections to the other components is illustrated. As shown in FIG. 2, the DVR system 14 includes a DVR server 38. The DVR server 38 includes video channels 40 for receiving the video feeds from the video cameras 24 at the site being monitored 20. The DVR server 38 also includes integration inputs 42*a*, 42*b*, 42*c* for devices such as point-of-sale locations, automated teller machines (ATMs) and other access device integration, such as access control cards. The integration inputs 42*a*, 42*b*, 42*c* allow for various other devices to be monitored. For example, if someone attempts to break into an ATM that is located at the site being monitored 20, a sensor in the ATM can send an alert.

The DVR server 38 also includes relay inputs and outputs 43 (as shown, four outputs and 16 inputs) that are used to trigger the alarms from the doors or other sensors. The DVR server 38 may also include a DVD/CD reader/writer 44 and mass hard drive storage 46. Various video interfaces 48 are also included in the DVR server 38. The video interfaces may include a cycling video interface 48*a*, a multiplex video 48*b*, and dual VGA interfaces 48*c*, which allow for user interface at the site being monitored 20.

As shown in FIG. 2, the DVR system 14 is connected to a network hub 50. The network hub 50 can be connected to any number of other DVR servers 52. The network hub 50 is also connected to the central archive manager 23 to back-up the data storage of all of the DVR servers 38, 52 and to store any data that needs to be removed from the DVR servers 38, 52. Remote client access 54 is also connected to the network hub 50. The remote client access 54 allows the client to log-in and remotely manage and monitor the sites 20. The client can also log in remotely using a handheld PDA device 56 and accessing the DVR system 14 via a wireless 802.11 connection 58 or wireless connectivity. A CAM web browser 59 is also provided to provide explorer access to review incidents from the central archive manager 23.

Figure 3:
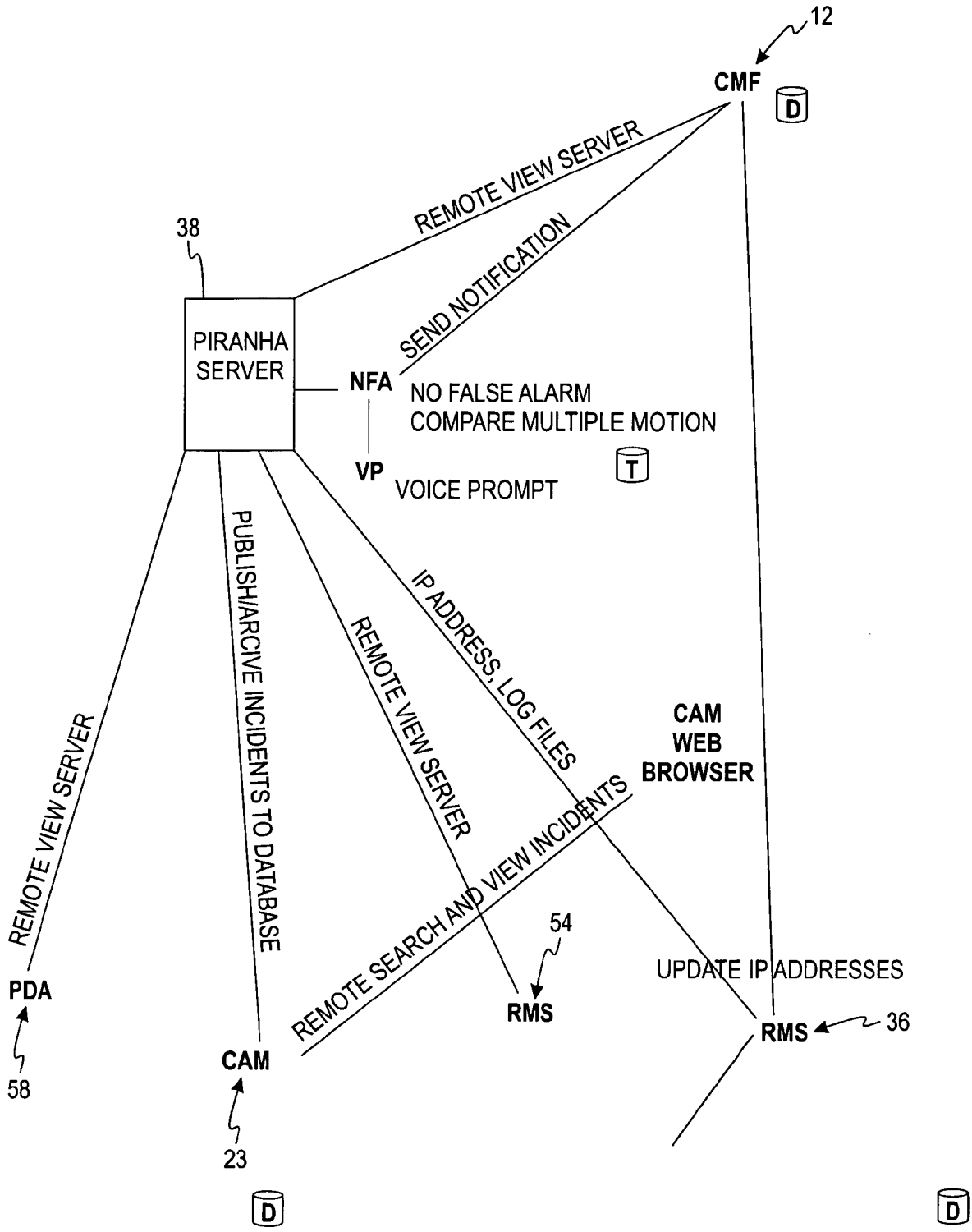
FIG. 3 is a functional diagram of the monitoring system according to one embodiment of the present invention.

Turning now to FIG. 3, an operation of the present application will be described. As illustrated, the DVR server 38 transmit the log files and the IP address information to the remote manager server 36 for storage and management as described above. The DVR server 38 also transmits incidents to a central archive manager 23 for storage. If the DVR server 38 detects an alarm situation, the DVR server 38 activates a no false alarm algorithm (to be described in detail in FIG. 6 below). If the no false alarm algorithm indicates that it is a true alarm situation, it alerts the central server 12 through the remote manager server 36 routing the alarm to the best workstation 32 (utilizing skills-based routing). In some embodiments, the central server 12 may activate a voice prompt (the voice recordings described above).

The central server 12 obtains the IP address and information from the remote manager server 36 and then obtains the streaming audio and/or video and incident information from the DVR server 38. The information is now available to be viewed by security personnel via the workstation 32. Also, the DVR server 38 is connected to the remote client access 54 and the wireless client access 58 to allow for client viewing of the events. Clients have the ability to log-in to the remote manager server 36 and monitor live or archived video from the DVR server 38. Clients can also remotely view reports and incidents from the central archive manager 23.

Figure 4:
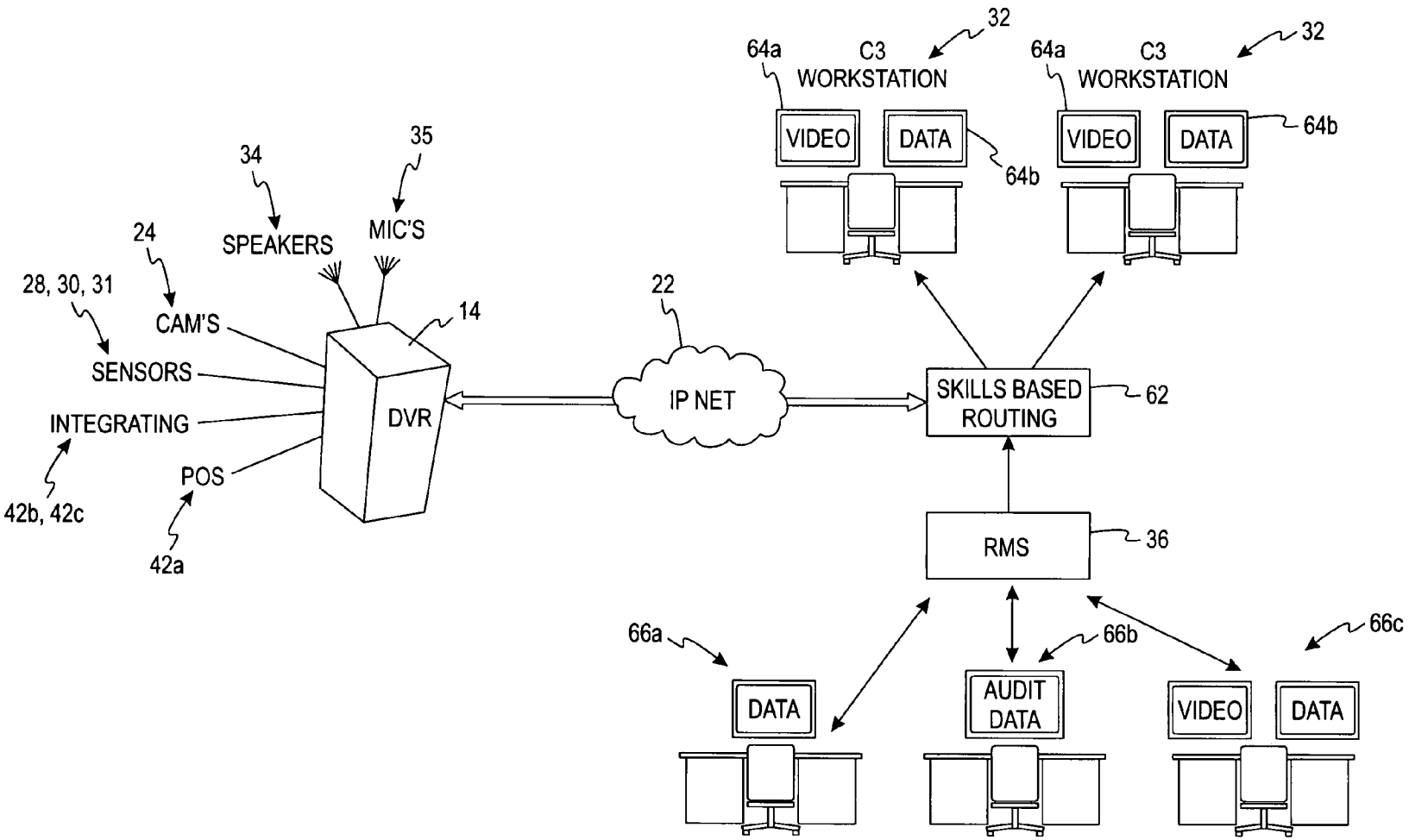
FIG. 4 is a network diagram of the monitoring system according to one embodiment of the present invention.

Turning now to FIG. 4, a network diagram according to one embodiment of the monitoring system 10 will be described. As illustrated in this embodiment, the site being monitored 20 includes the DVR system 14. The DVR system 14 includes inputs for receiving data from the various security devices 16. The DVR system 14 illustrated has inputs for receiving information from the cameras 24, the speakers 34, the microphones 35, the sensors 28, 30, 31, the integration inputs 42*b*, 42*c* and point-of-sale integration 42*a*. As described above in reference to FIGS. 1 and 2, the DVR system 14 communicates with the remote manager server 36 via IP connectivity 22. The remote manager server 36 receives data, including audio and video files from the DVR system 14, and the DVR system 14 receives updates regarding IP addresses and other information from the remote manager server 36.

In response to receiving an alarm condition, the remote manager server 36 uses skills-based routing 62 to route the alarm to the workstation 32 at a central command center that is best able to respond to the alarm. In the illustrated embodiment, the workstation 32 includes one display 64*a* for playing video and audio files and a second display 64*b* for displaying statistical data and other information. Workstations 32 in other embodiments may include any number of monitors 64.

The remote manager server 36 also communicates data to a plurality of workstations 66 at a back office. These workstations 66 can perform the business survey/audit information described above. In the illustrated embodiment, a first workstation 66*a* is dedicated to reviewing data management. A second workstation 66*b* reviews audit data and a third workstation 66*c* performs tours and audits utilizing the video, audio and data from the DVR system 14. In other embodiments, there may be any number of workstations 66.

Figure 5:
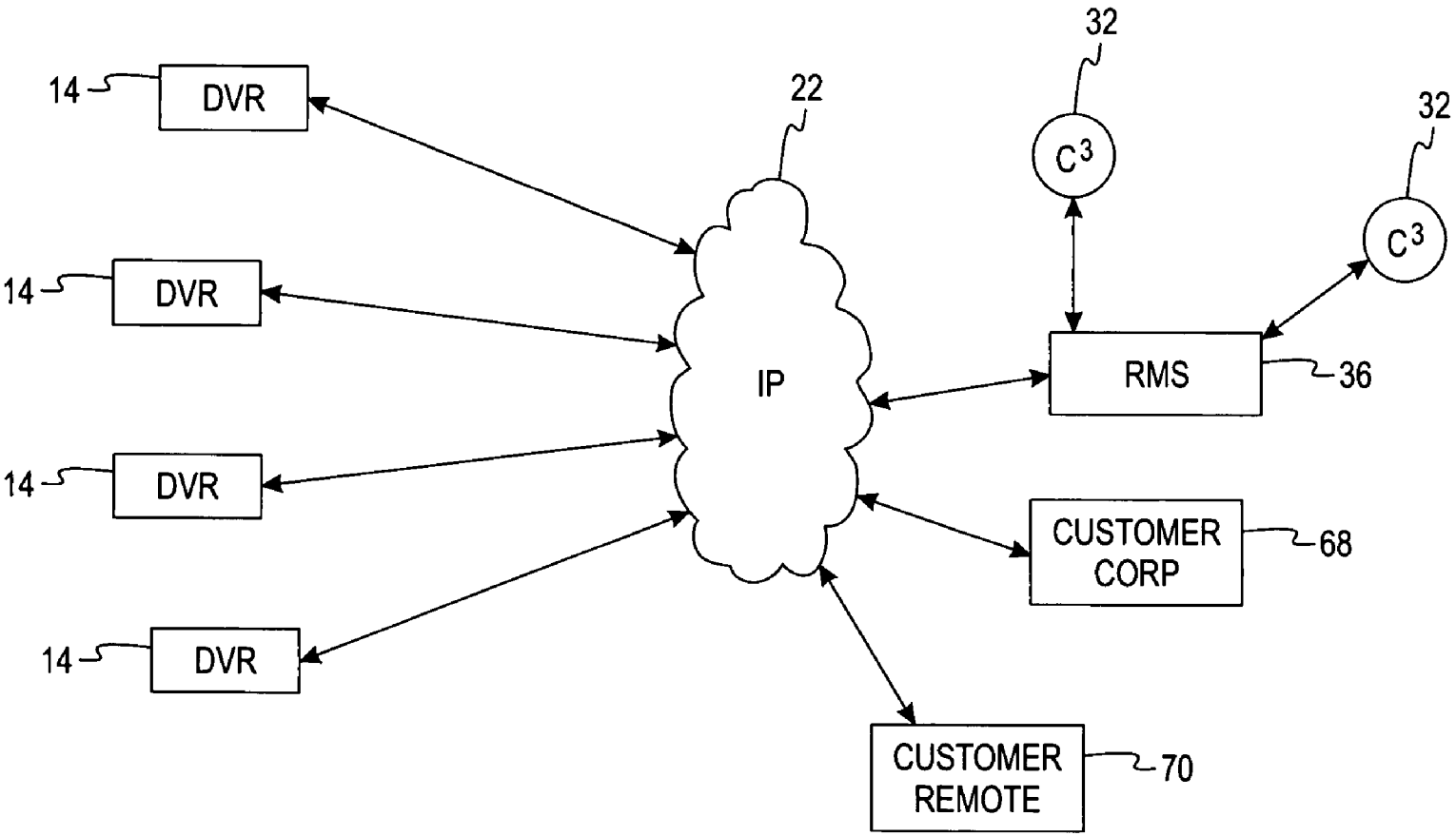
FIG. 5 is an enterprise diagram of the monitoring system according to one embodiment of the present invention.

FIG. 5 illustrates an enterprise map of an entire system. As shown, a plurality of DVR systems 14. Each DVR system 14 is coupled to the remote manager server 36 via IP connectivity. The remote manager server 36 connects to a plurality of workstations 32.

The DVR systems 14 are also connected to the client's internal network 68, allowing the client to access the data gathered by the DVR systems 14 via the IP connectivity. The customer can also log-on remotely from a remote access site 70. As described above in reference to FIGS. 2 and 3, this access can be a land-line access or it can be wireless.

Figure 6:
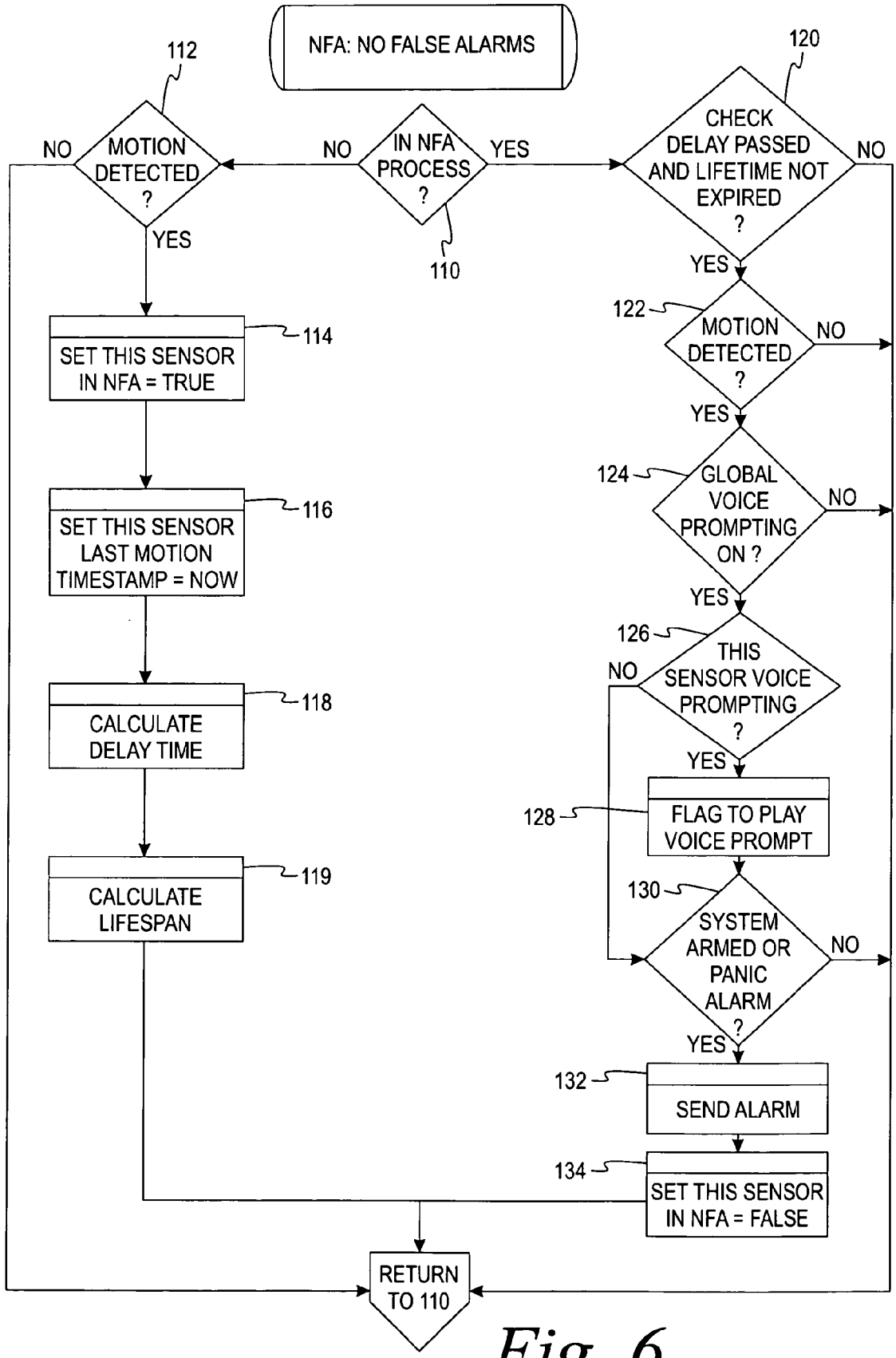
FIG. 6 is a flow chart illustrating a no false alarm process according to one embodiment of the present invention.

Turning now to FIG. 6, a flow chart describing one feature of the present application is shown. As stated above, it is sometimes a problem in current surveillance systems that false alarms are raised, resulting in the police or other authorities being notified when there really is not a need. In this embodiment of the present invention, they system 10 attempts to eliminate false alarms. As illustrated, at step 110, it is determined whether the no false alarm (NFA) algorithm is in progress, meaning that it is determined if there has already been motion detected. If the answer is no, the system advances to step 112 to determine whether a motion has been detected. If a motion is not detected, the system returns to step 110. If a motion is detected, then at step 114, the sensor that detected motion is set for NFA equals true. Next, at step 116, the time of the alarm is timestamped and at step 118, the lifespan is calculated.

If, at step 110, the NFA process is already in progress (there has already been a motion detected), at step 120, it is determined whether a predetermined delay has passed and whether a lifetime is not expired. For example, the process reviews the time stamp set in step 116 and the lifetime calculated at step 118. In some embodiments, the lifespan is between 1 and 5 seconds, preferably about 3 seconds. Step 120 is determining whether another motion is detected within a predetermined amount of time. If the answer to one of these questions is no, then the process returns to step 110. If both the delay has passed and a lifetime is not expired, then it is determined whether a motion has been detected at step 122. If the answer is no, then the process returns to step 110. If motion is detected, the system, at step 124, determines whether the global voice prompting is on. If it is not, then the process returns to step 110. If the global voice prompting is on, it is then determined at step 126 if this sensor has voice prompting. If the sensor has voice prompting, the process advances to step 128 and sets the flag to play the voice prompt, and advances to step 130. If the global voice prompting is not on, the process automatically advances to step 130. At step 130, it is determined whether the system is armed or is in panic alarm. If the answer is no, then the system returns to step 110. If the answer is yes, then at step 132, an alarm is sent and the sensor is reset to NFA being false. The system then returns to step 110.

Returning now to FIG. 2, the DVR system 14 will be described as to its various functions and capabilities. The DVR system 14 runs a software application 60 on the DVR server 38 that manages the local configurations and maintains communications with the centralized remote manager server 36. The software application 60 may be programmed to maintain system uptime, camera outage notification, centralization of log files, downloading of configuration changes, downloading of application changes, and management of dynamic IP addresses. The software application 60 may also organize and manage the content on the DVR server 38 and run tasks sent by the remote manager server 36.

The software application 60 is the software that sends the alarm events to the central server 12. When sending an event notification to the remote manager server 36, the software application includes details such as system identification, site timestamp, alert type, and identifies the device that triggered the event.

The software system also manages the no false alarm engine described above in FIG. 6. As stated above, the no false alarm system confirms motion activity on cameras (or sensors) that trigger events based on several variables. As a camera (or sensor) motion event is triggered, the process described in FIG. 6 confirms that motion over a short period of time to verify that the detected motion is not a false alarm. The software system may also require a secondary device detection. The secondary device detection requires two devices to recognize an event condition simultaneously. The two devices could be a combination of any two of the security devices 16 (two cameras, a camera and a motion sensor, etc . . . ). Typical DVR platforms trigger too many false alarms, which is costly and time-consuming.

The software application 60 also generates system log files based on event activity and can then transmits these log files to the remote manager servers 36 and the central archive manager 23.

Another function of the software application is to provide automated voice prompting. As described above, upon certain events, an audio file is transmitted to the speakers 34. The audio file may be a warning to an intruder or a greeting to a guest. The predefined voice messages are important, as they supply a consistent message from the central server 12.

The software application can also perform health check management by communicating with the remote sites for connectivity, system stability and video to the cameras. If any systems are not working properly, a notification is delivered to personnel at the remote surveillance monitoring location 18. The systems are checked every five minutes or other predetermined interval.

As shown in FIG. 1, the workstations 32 at the remote surveillance monitoring location 18 are linked to the central server 12 that distributes alerts to workstations 32 based on operator skills profiling and rules offering near 1-second responses incoming alerts over IP. The central server 12 works hand-in-hand with the remote manager server 36 to receive and manage the DVR system 14 information. The central server has the following applications:

1. The Alarm Viewer is an application that responds to incoming alerts providing instant searching and playback of audio and video based on alarms.

2. The Site Viewer provides toolsets to search all sites on a network by any criteria and remotely login streaming audio and video.

3. The Tour Viewer provides a schedule of sites to proactively visit and generate audit reports.

First, the Alarm Viewer is a robust interface communicating with the remote manager server 36 to provide detailed critical information on an incoming event such as key contacts, address, current IP Address, location map, site map, and facility photo. Additional operator specific information support scripts, protocol definition, incident history, site specific rules and much more. When an event is received, the Alarm Viewer prioritizes the event for review. Upon event selection, playback of the video-recorded incident is immediate with supporting site details. A full screen view of all site cameras and a full history of video is accessible on the secondary monitor interface. Activation of the automated voice commands and live voice features is also available if the user needs to audibly communicate with the remote site. In some embodiments, the events require an operator to close the incident with comments while the remote manager server 36 is tracking and recording operator interactions.

The Site Viewer is an interface that communicates with the remote manger server 36 to generate critical information on a site like contacts, address, current IP Address, and search criteria. The Site Viewer offers all the features of Alarm Viewer interface with the addition of site search criteria. In some embodiments, events are not received on the Site Viewer, Operators proactively visit sites based on search criteria. Additional features include remote arming of sites, remote reboot of system and much more.

Tours are meant to be proactive audible and visual visits to the site confirming store procedures are being followed. The Tour Viewer receives events much like the Alarm Viewer except the events are automated tours scheduled within the remote manager server 36. Tours arrive on predefined schedules requiring the operator to log into the remote site, answer predefined questions about the site and personnel, potentially communicate with the remote site and close the session with comments while the remote manager server 36 is always tracking interactions.

The Alarm Viewer has a queue process with 3 priorities (low, med, high). All events incoming are assigned a priority and are sorted based on timestamp. This linear alert prioritization offers the user the flexibility to monitor several events simultaneously but focus on the higher priority situations.

Some low priority event types will automatically escalate to medium priority, then high priority if the alert has not been addressed within the user specified time frame.

Audible descriptions announce the Alarm or events landing on operators workstation. The central server 12 has the intelligence that allows the user to discern critical situations from those that do not require immediate response, such as the notification of delayed actions or messaging.

The central server 12 has extended remote site capabilities including:

1. Remote arming and disarming
2. Remote system reboot
3. Remote Synthetic Voice Down Remote Site Arming or the e-Alarm panel allows the security personnel or operator at the remote surveillance monitoring location 18 the ability to recognize a disarmed site that by policy should be armed. By clicking "ARM", the remote site will initiate a countdown and arm itself to send alerts.

Remote Reboot allows the operator to resolve hardware or software issues by rebooting the remote DVR Server 38. This option depends upon the remote DVR server 38 being operational, network connectivity and the remote manager server 36 having current IP Configuration data. This process mitigates local intervention.

Synthetic Voice Down allows the operator the ability to trigger prerecorded voice commands played through the remote site audio system 34. These voice downs are critical for low bandwidth sites, or in automated scenarios. For example, the Automated Synthetic Voice Down could communicate with kids in a parking lot at 2:00 AM to leave the area or the police will be notified. In case the people do not respond, the police can then be called by the operator.

In some embodiments of the present invention, in addition to providing security to the client, the system 10 can also provide audits of the facility while it is in use. For example, operators at the workstations 32 (FIG. 1) can view the output from the cameras 24 (either in real-time or recorded) to see how often certain tasks are being accomplished and to check on the cleanliness of the facility. For example, if the site being monitored 20 is a restaurant, the operator could view the cameras in the facility to see whether the shelves are being restocked properly and how often they are being restocked. The microphones 35 could be used to record conversations between the customers and the employees to ensure that the employees are conveying correct information in a polite manner.

In some embodiments, all the audit information is delivered to an IP/web page offering exception reporting of the site being monitored 20 to the client. If the client has multiple sites 20 that are monitored, the remote manager server 36 can assemble the reports from each site being monitored 20. All of the data would be centralized on the remote manager server 36 and could be accessed by the customer via a customer portal.

The reports themselves can include site uptime, the total alarms for the week, the open and close times of the site (especially helpful if the site is a store or retail facility), activity involving opening/closing the safe (including whether the safe was left open for more than five minutes), point-of-sale transactions with a void over a set dollar limit (e.g., over $100), and whether any doors were left open over a predetermined amount of time or past a certain time at night.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of performing remote surveillance comprising:

detecting a first event at a first location via surveillance equipment;

detecting a second event at the first location via the surveillance equipment; and alerting a central server at a second location via IP connectivity in response to the first and second events occurring within a predetermined time limit.

2. The method of claim 1, wherein the first event is detected by a first surveillance device and the second event is detected by a second surveillance device.

3. The method of claim 2, wherein the predetermined time limit is less than about one second such that the first and second events occur about simultaneously.

4. The method of claim 1, wherein the first and second events are detected by a single surveillance device.

5. A method of performing remote surveillance comprising:

detecting a first event at a first location via surveillance equipment;

assigning a first timestamp at a central server upon detecting the first event;

detecting a second event at the first location via surveillance equipment;

assigning a second timestamp at the central server upon detecting the second event;

comparing the first timestamp and second timestamp at the central server to see if a predetermined delay has passed and whether a lifetime has not expired; and playing a global voice prompt at the first location if the central server has determined that the predetermined delay has been passed.

6. The method of claim 5, wherein the second event takes place at a location other than the first location.

7. The method of claim 5, wherein the predetermined delay is between 1 and 5 seconds.

8. The method of claim 5 wherein the predetermined delay is about 3 seconds.

9. The method of claim 1, wherein the surveillance equipment is at least one of a camera, a motion detector, a panic button, a door sensor, a sensor, and any combination thereof.

10. The method of claim 1, further comprising:

providing communications equipment at the first location;

transmitting data from the surveillance equipment via IP connectivity to the second location;

monitoring the data in real-time from the second location;

transmitting an audio signal from the second location to the communications equipment at the first location; and receiving an audio signal from the communications equipment from the first location at the second location.

11. The method of claim 10, further comprising recording and centralizing the data.

12. The method of claim 11, further comprising recording the data via a digital video recorder.

13. The method of claim 12, wherein the digital video recorder includes a digital video recorder server adapted to communicate via the internet with the central server.

14. The method of claim 1, wherein the second location is remote from the first location.

15. The method of claim 1, further comprising allowing, via a microphone at the first location, bi-directional communication with the second location.

16. The method of claim 1, wherein the predetermined time limit is between 1 and 5 seconds.

17. The method of claim 16, wherein the predetermined time limit is about 3 seconds.

18. The method of claim 5, wherein the surveillance equipment is at least one of a camera, a motion detector, a panic button, a door sensor, a sensor, and any combination thereof.

* * * * *